US010974373B2

(12) United States Patent
Thompson

(10) Patent No.: US 10,974,373 B2
(45) Date of Patent: Apr. 13, 2021

(54) RATCHETING WRENCH

(71) Applicant: Snap-on Incorporated, Kenosha, WI (US)

(72) Inventor: Christopher D. Thompson, Franklin, WI (US)

(73) Assignee: Snap-on Incorporated, Kenosha, WI (US)

( * ) Notice: Subject to any disclaimer, the term of this patent is extended or adjusted under 35 U.S.C. 154(b) by 349 days.

(21) Appl. No.: 16/121,908

(22) Filed: Sep. 5, 2018

(65) Prior Publication Data

US 2020/0070323 A1 Mar. 5, 2020

(51) Int. Cl.
*B25B 23/00* (2006.01)
*B25B 13/46* (2006.01)
*B25G 1/06* (2006.01)

(52) U.S. Cl.
CPC ..... *B25B 23/0035* (2013.01); *B25B 13/465* (2013.01); *B25B 23/0028* (2013.01); *B25G 1/063* (2013.01)

(58) Field of Classification Search
CPC ..... B25B 23/0035; B25B 23/0028; B25B 13/463; B25G 3/14; B25G 3/38; B25G 3/12; B25G 3/18; B25G 3/28
See application file for complete search history.

(56) References Cited

U.S. PATENT DOCUMENTS 1,578,065 A * 3/1926 Bemus ..... B25B 13/463 81/61
1,614,039 A 1/1927 Mandl
2,529,476 A 11/1950 Albertson
4,406,186 A 9/1983 Gummow
4,596,167 A 6/1986 White, Jr.
5,168,782 A * 12/1992 Cromwell ..... B25B 23/0021 81/177.2
5,349,620 A 9/1994 White et al.
5,419,221 A 5/1995 Cole
H1689 H * 11/1997 Foucher ..... B25G 1/063 81/124.2
5,768,960 A * 6/1998 Archuleta ..... B25G 1/066 403/84
5,775,184 A 7/1998 Cole
5,941,141 A 8/1999 Whitley
6,000,299 A 12/1999 Cole
(Continued)

FOREIGN PATENT DOCUMENTS

CN 207643027 U 7/2018
EP 1004403 A2 5/2000
(Continued)

OTHER PUBLICATIONS

Australia Examination Report No. 1 for Application No. 2019213406 dated Jun. 3, 2020, 4 pages.
(Continued)

*Primary Examiner* — David B. Thomas
(74) *Attorney, Agent, or Firm* — Seyfarth Shaw LLP

(57) ABSTRACT

A ratcheting wrench with ratchet heads coupled to a handle via a pin. The pin includes two ball detents that couple to the teeth of the spline in and an indent inside an opening of the ratchet head. The wrench can therefore be easily used in low profile applications and quickly adjusted due to the dual ball detent configuration of the pin.

19 Claims, 7 Drawing Sheets

(56) References Cited

U.S. PATENT DOCUMENTS

| | | | | |
|---|---|---|---|---|
| 6,032,555 | A | 3/2000 | Whitley | |
| 6,101,907 | A | 8/2000 | McGovern et al. | |
| 6,247,386 | B1 | 6/2001 | Gummow | |
| 6,550,357 | B1 | 4/2003 | Freeman | |
| 6,588,304 | B2 | 7/2003 | Kady et al. | |
| 6,845,692 | B2 | 1/2005 | Cooper | |
| 7,182,000 | B1 | 2/2007 | Dicksen | |
| 7,197,965 | B1 | 4/2007 | Anderson | |
| 7,373,861 | B2 * | 5/2008 | Hsieh | B25G 1/063 403/93 |
| 7,987,749 | B2 * | 8/2011 | Hsieh | B25G 1/063 81/177.8 |
| 8,156,845 | B2 | 4/2012 | Lin | |
| 8,205,529 | B1 | 6/2012 | Laurie | |
| 8,485,068 | B2 | 7/2013 | Campbell | |
| 8,646,365 | B2 * | 2/2014 | Hsieh | B25G 1/063 81/177.8 |
| 9,364,943 | B2 * | 6/2016 | Chang | B25G 1/063 |
| 9,597,782 | B2 * | 3/2017 | Abel | B25B 13/461 |
| 2003/0131692 | A1 | 7/2003 | Huang | |
| 2003/0136230 | A1 | 7/2003 | Chen | |
| 2006/0048609 | A1 | 3/2006 | Shih | |
| 2007/0034058 | A1 | 2/2007 | Chen | |
| 2013/0118320 | A1 | 5/2013 | Richardson | |
| 2014/0033877 | A1 | 2/2014 | Lee | |
| 2016/0332284 | A1 * | 11/2016 | Zhang | B25B 13/481 |
| 2017/0210000 | A1 | 7/2017 | Lee | |
| 2017/0348833 | A1 * | 12/2017 | Curtis | B25G 1/007 |
| 2018/0043512 | A1 * | 2/2018 | Zhang | B25B 13/481 |
| 2019/0337140 | A1 * | 11/2019 | Shanklin | B25G 1/007 |

FOREIGN PATENT DOCUMENTS

| | | |
|---|---|---|
| TW | 200621434 A | 7/2006 |
| TW | M394205 | 12/2010 |
| TW | 201249604 A | 12/2012 |
| TW | I380879 | 1/2013 |
| TW | M495927 | 2/2015 |

OTHER PUBLICATIONS

Combined Search and Examination Report for Application No. GB1912266.2 dated Feb. 3, 2020, 8 pages.

Taiwan Office Action for Application No. 10920261260 dated Mar. 20, 2020, 11 pages.

Taiwan Office Action for Application No. 10920965950 dated Oct. 7, 2020, 2 pages, no English translation.

Canadian Office Action for Application No. 3,052,750 dated Oct. 14, 2020, 3 pages.

Chinese Office Action for Application No. 201910824418.7 dated Dec. 21, 2020, 10 pages.

Examination Report No. 2 for Application No. 2019213406 dated Jan. 12, 2021, 5 pages.

* cited by examiner

RATCHETING WRENCH

TECHNICAL FIELD OF THE INVENTION

The present invention relates generally to hand-held tools. More particularly, the present invention relates to a low profile indexable ratcheting wrench.

BACKGROUND OF THE INVENTION

Indexable ratcheting wrenches are a well-known tool for applying torque to work pieces. The ratcheting wrench includes a handle portion connected to a head portion, where the head portion conventionally connects to a socket. The socket then receives a work piece and applies torque to the work piece based on the selective rotation of the handle. Indexable ratcheting wrenches allow a user to apply torque with a ratcheting mechanism, while at the same time reaching hard to reach work pieces.

Conventional ratcheting wrenches use sockets to transfer torque to work pieces at the work piece, which can reduce ability in low profile or hard to reach settings. Still other conventional ratcheting wrenches connect the handle portion of the wrench to the head portion in a manner that is awkward, structurally unstable, or difficult to adjust.

SUMMARY OF THE INVENTION

The present invention broadly comprises a ratcheting wrench for use in, for example, low profile applications. In an embodiment, the wrench includes ratchet heads, rather than requiring a socket, to engage and transfer torque to the work piece. The wrench can further include a pin that couples a handle to the ratchet head, where the pin includes two ball detents: one for coupling with the teeth of the spline in the handle opening, and another for coupling with an indent inside an opening of the ratchet head. The wrench can therefore be used in low profile applications and is adjustable due to the dual ball detent configuration of the pin.

For example, the present invention broadly comprises a tool including a handle having first and second opposite ends with a spline at the first end. The tool can also include a wrench head having first and second opposing ends, with a drive portion at the first end and a working portion at a second end opposite the first end. A pin can further be included and can have first and second ball detents, the first ball detent coupling with the handle and the second ball detent coupling with the wrench head.

The present invention also broadly comprises a tool including a handle, a pin coupled to the handle, and a wrench head coupled to the pin. The pin can include first and second ball detents, the first ball detent coupling with the handle and the second ball detent coupling with the wrench head. The pin can further include a round portion and a square portion extending from the round portion, the first ball detent extending at least partially within the round portion and the second ball detent extending within the square portion.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
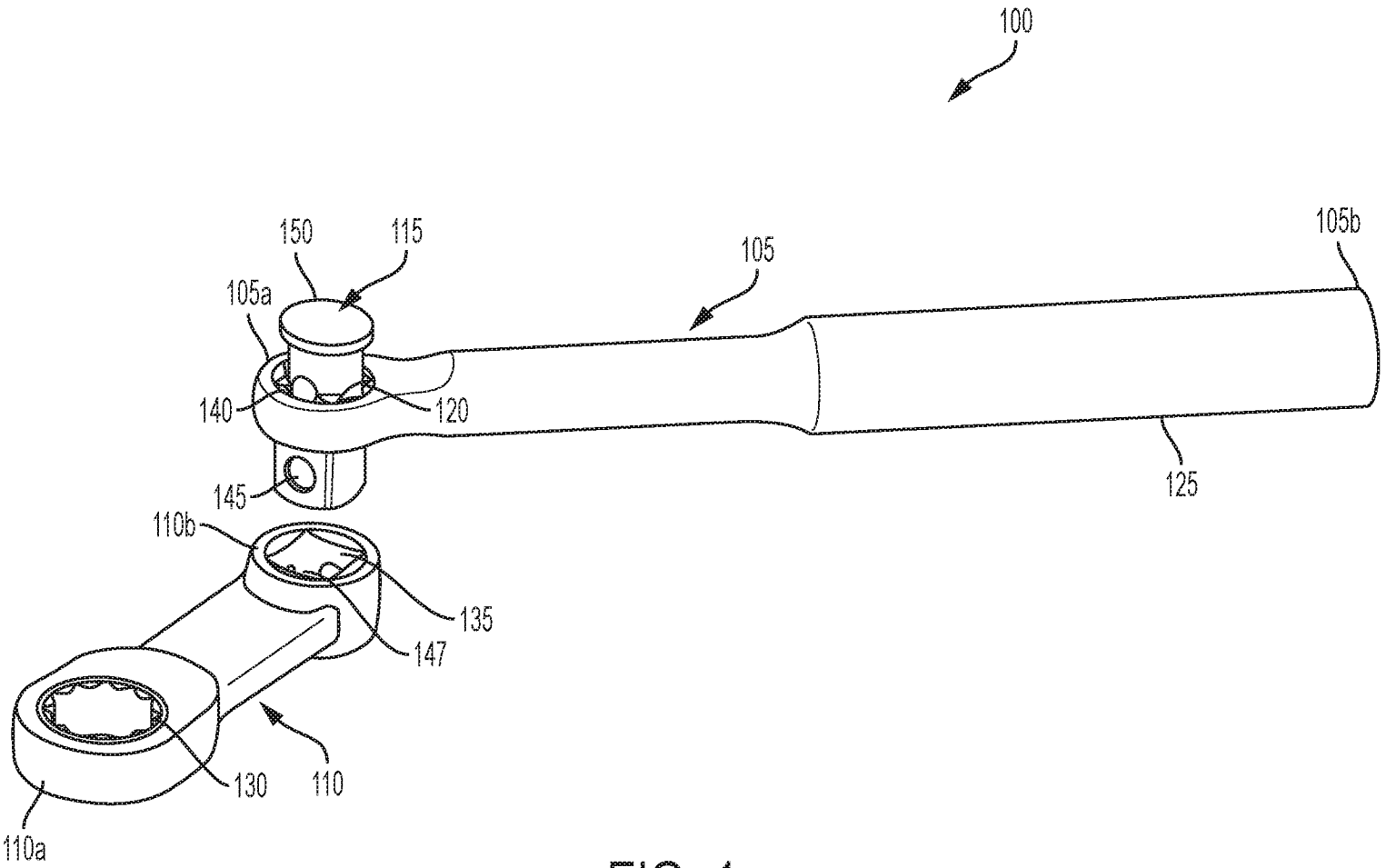
FIG. 1 illustrates a partially exploded front perspective view of a tool according to at least some embodiments of the present invention.

While the present invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a ratcheting wrench with interchangeable ratchet heads to allow for low profile applications. The ratchet heads can be coupled to a handle via a pin. The pin can include two ball detents that respectively couple to the teeth of the spline in the handle opening and an indent inside an opening of the ratchet head. The wrench can therefore be easily used in low profile applications and quickly adjusted due to the dual ball detent configuration of the pin.

Referring to FIG. 1, a tool 100 can include a handle 105 coupled to a wrench head 110 via a pin 115. The handle 105 can have first 105*a* and second 105*b* ends opposite one another, where a spline 120 can be located near the first end 105*a* and a grip 125 can be located near a second end 105*b*. The wrench head 110 can have a working portion 130 located proximate a first end 110*a* of the wrench head 110 and a drive portion 135 located proximate a second end 110*b* of the wrench head 110. The pin 115 can insert through the spline 140 and couple with the wrench head 110 at the drive portion 135. For example, the pin 115 can include first 140 and second 145 ball detents extending radially from the pin 115 and coupling with teeth of the spline 140 and an indent 147 within the drive portion 135, respectively. The pin 115 can also include a cap 150 to facilitate the pushing of the pin 115 through the spline 140 and the drive portion 135.

Figure 2:
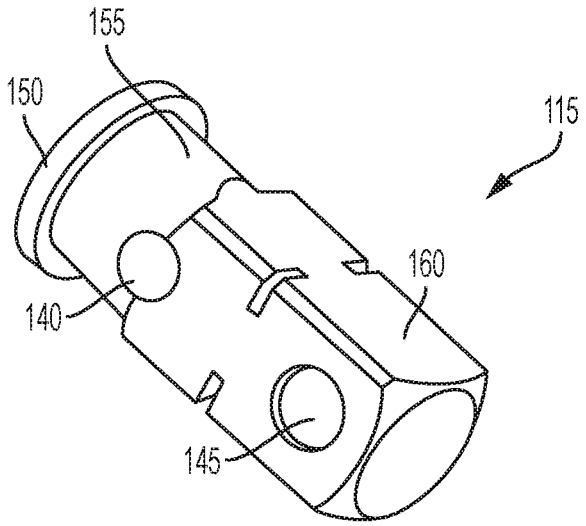
FIG. 2 illustrates a side perspective view of a pin according to at least some embodiments of the present invention.
Figure 3:
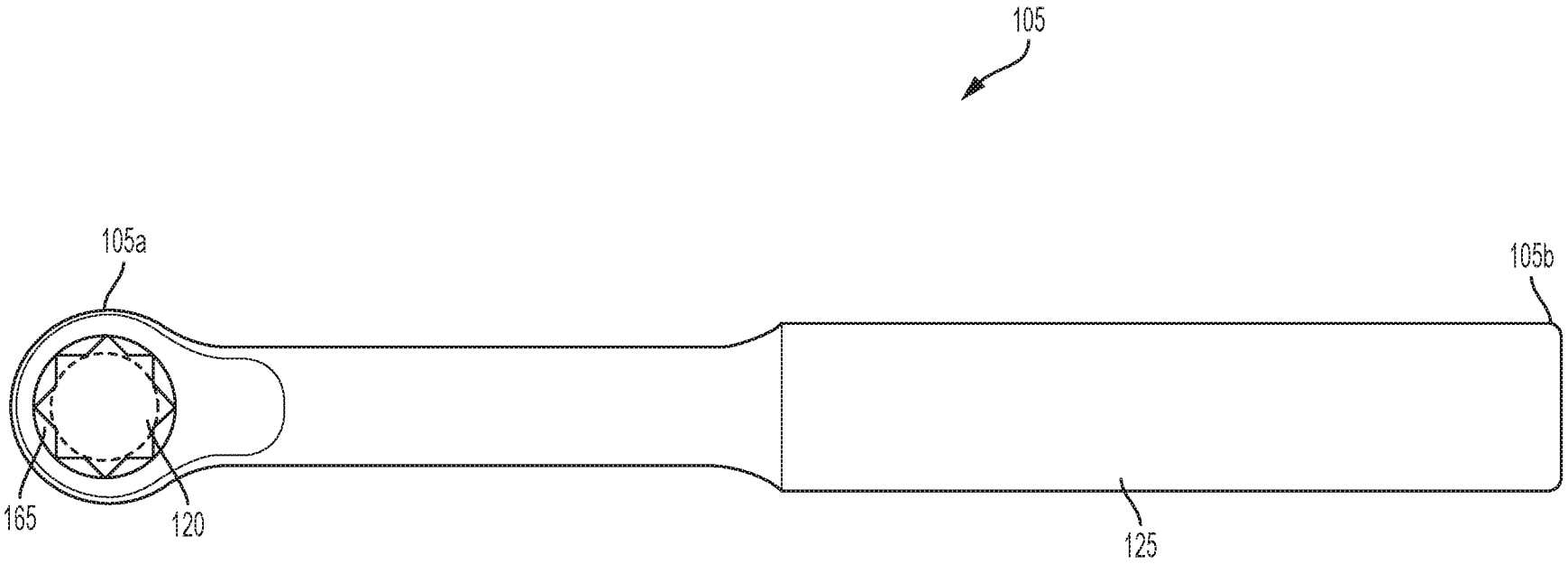
FIG. 3 illustrates a top view of a handle according to at least some embodiments of the present invention.
Figure 4A:
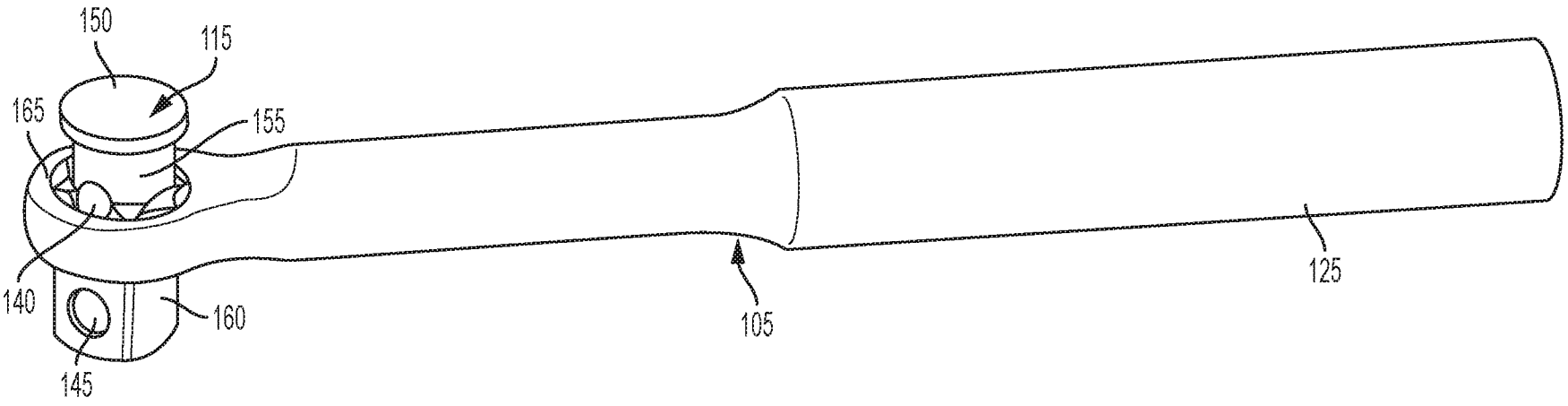
FIG. 4A illustrates a top perspective view of a handle and pin with the pin partially inserted according to at least some embodiments of the present invention.
Figure 4B:
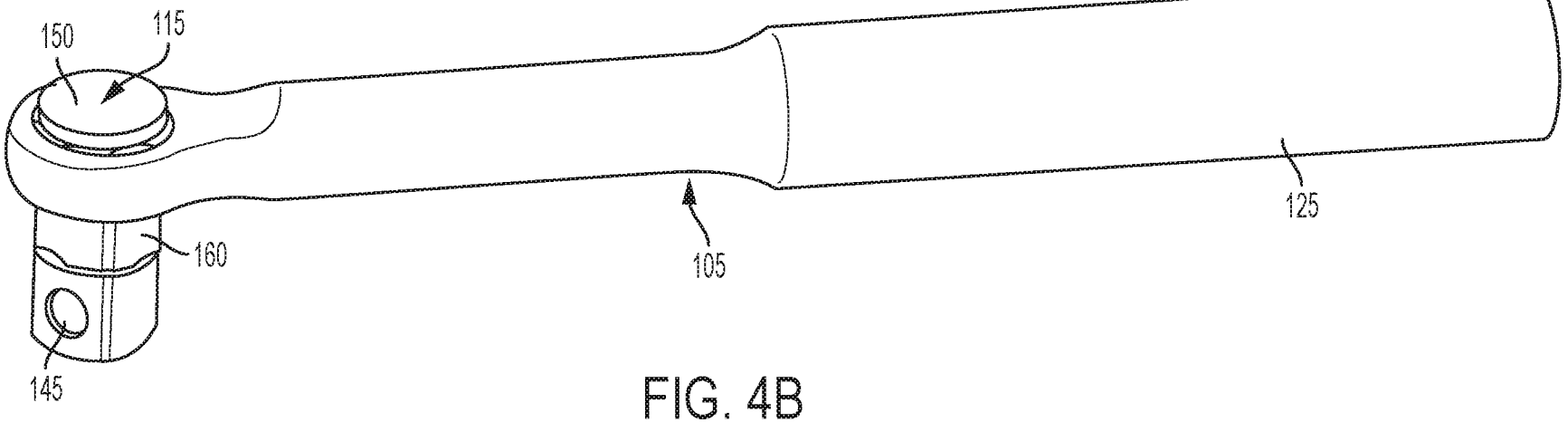
FIG. 4B illustrates a top perspective view of a handle and pin with the pin fully inserted according to at least some embodiments of the present invention.

As shown in FIG. 2, the pin 115 can include a round portion 155 and a square portion 160 extending from the round portion. The first ball detent 140 can extend across both the round portion 155 and the square portion 160, as shown. As shown in FIG. 3, the handle 105 can include teeth 165 at the spline 120. The round portion 155 can fit within the spline 120 and couple to the teeth 165 in the spline by engaging the first ball detent 140 into the teeth 165, as shown in FIGS. 4A and 4B. The first ball detent 140 can be elastically biased to extend outwardly and therefore can be, for example, spring-loaded to engage and couple with the teeth 165. The square portion 160 can then insert into the correspondingly-shaped drive portion 135 of the wrench head 110, and further couple the pin 115 to the wrench head 110 by engaging the elastically-biased second ball detent 145 with the indent 147.

Figure 5:
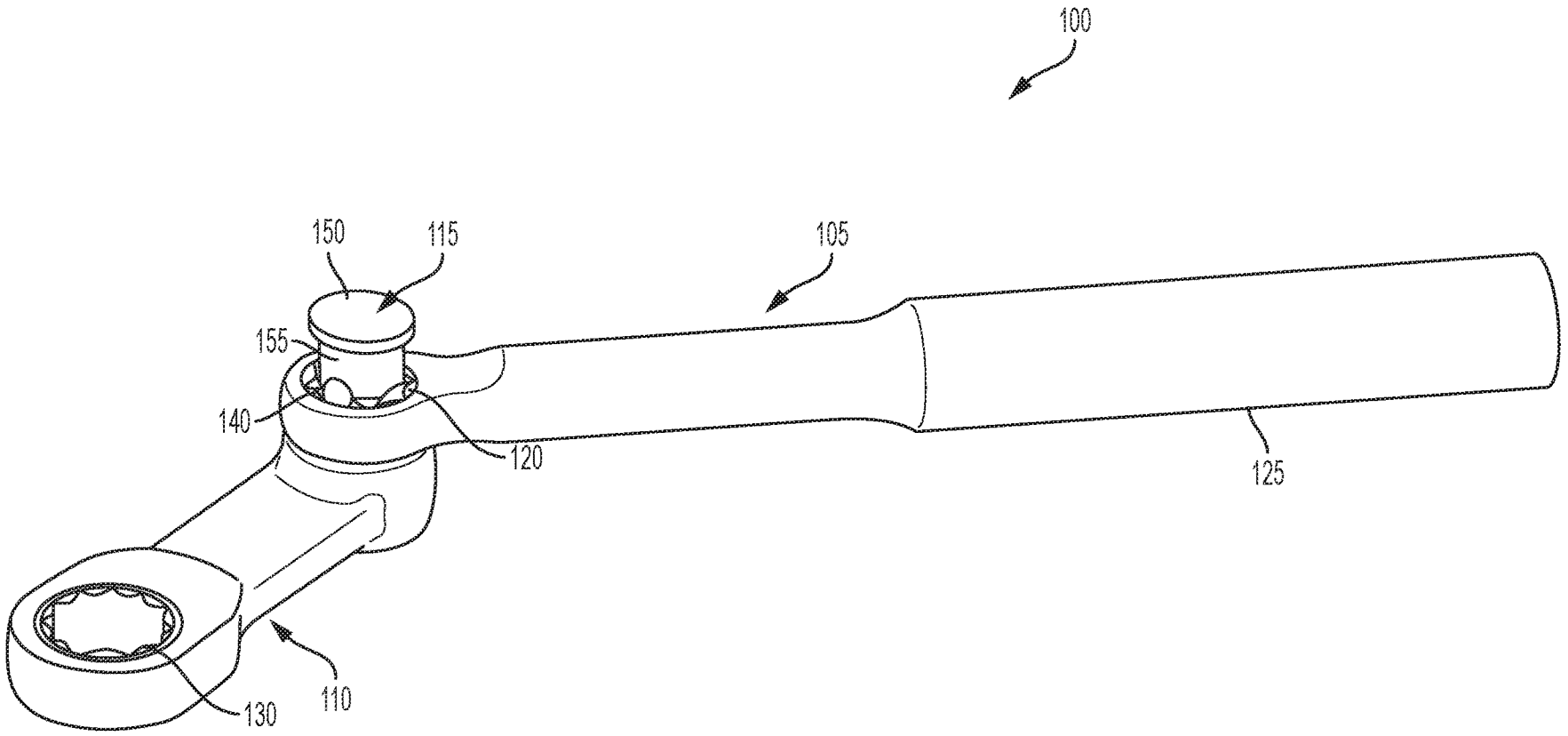
FIG. 5 illustrates the tool with the pin coupled to the ratchet head but with the handle detached from the first ball detent of the pin.
Figure 6:
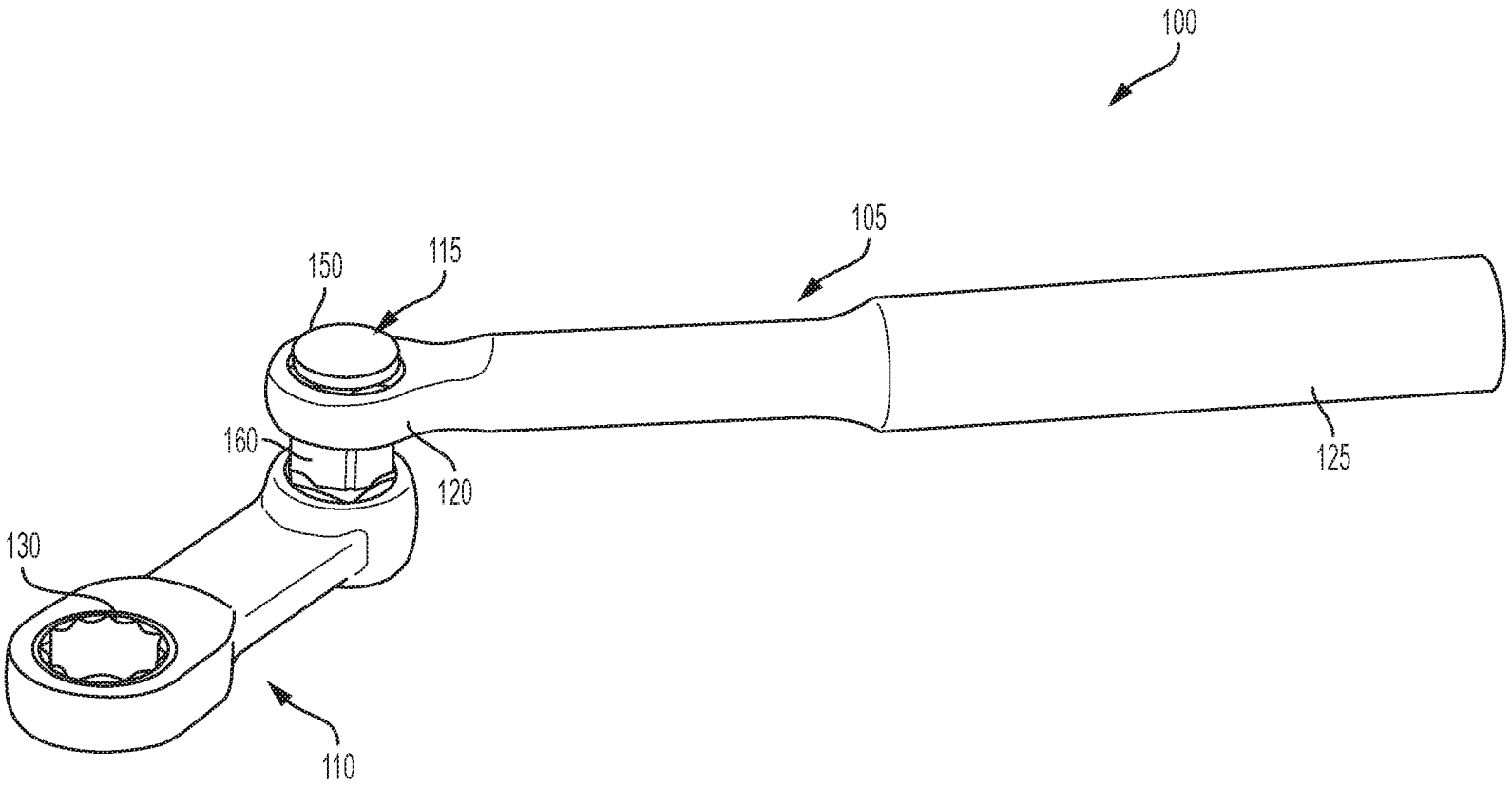
FIG. 6 illustrates the tool with the pin fully coupled to both the ratchet head and the handle.
Figure 7:
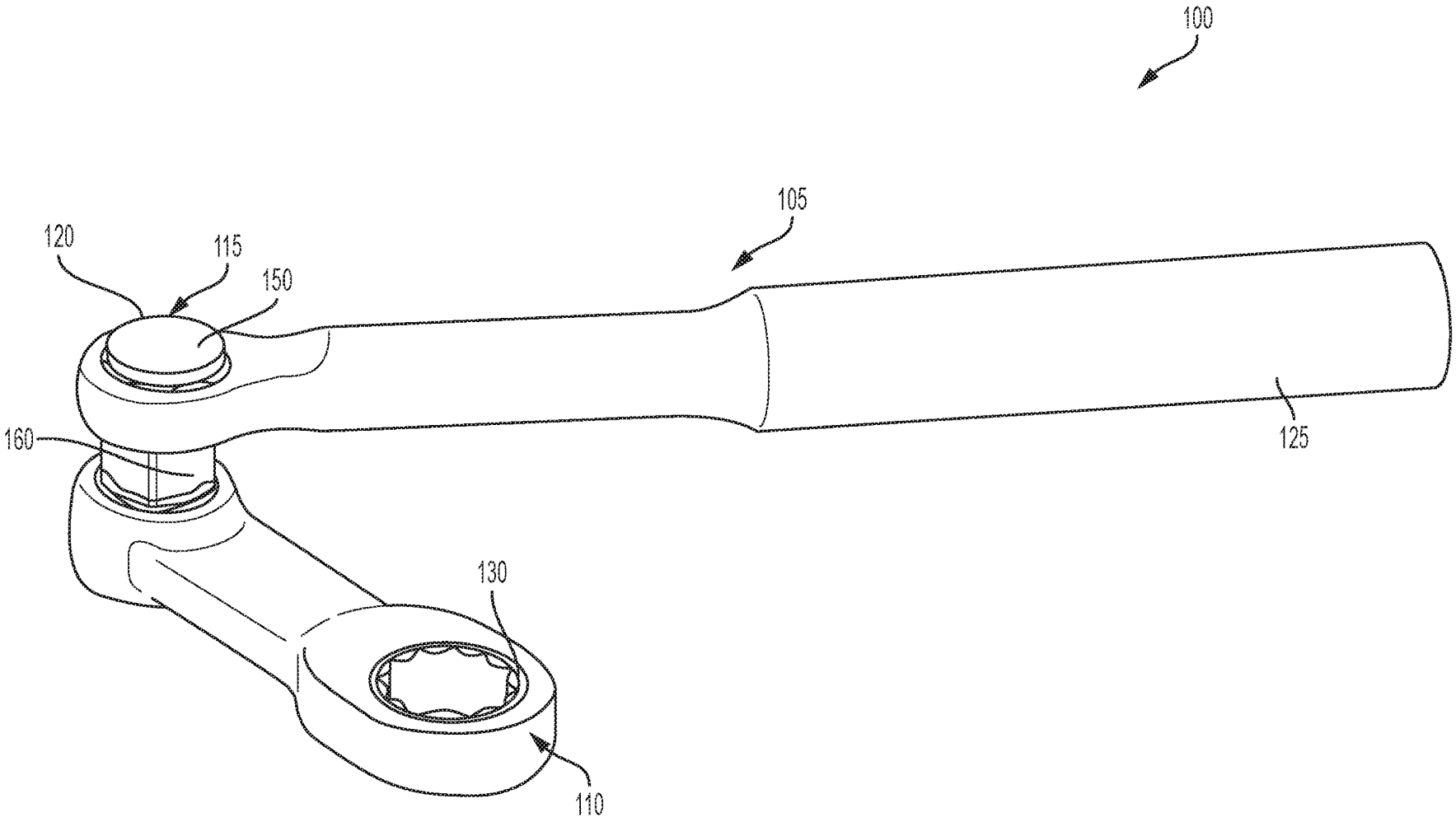
FIG. 7 illustrates the tool with the ratchet head oriented at a different angle than that shown in FIG. 5.

By including a first 140 and second 145 ball detent in the pin 115, the pin 115 can be more versatile and easily adjustable to rotate the wrench head 110 relative to the handle 105. The pin 115 can also couple to the handle 105 and wrench head 110 in either order: either the handle 105 first or the wrench head 110 first. For example, as shown in FIG. 5, the pin 115 can engage the wrench head 110 first by engaging the second ball detent 145 into the indent 147. The handle 105 can then be lifted upwardly and the first ball detent 140 can then engage the teeth 165 of the spline 120, as shown in FIG. 6. The wrench head 110 can therefore be a dedicated wrench head 110 with a working portion 130 adapted to engage a work piece, such as, for example, a bolt head or nut, and transfer torque to the work piece. This orientation avoids the need for a socket by instead using a dedicated wrench head 110 that couples to the pin 115. It will be appreciated that the working portion 130 can be shaped to be adapted to engage any type or shape of work piece, without departing from the scope of the present invention.

If a user wishes to rotate the wrench head 110 in any rotational orientation relative to the handle 105, the user can simply break the coupling between the teeth 165 and the first ball detent 140 by pushing the handle 105 downward (as shown in FIG. 5), and then rotate the wrench head 110 to the desired orientation. The handle 105 can then rotate freely around the pin because the round portion 155 has a diameter smaller than an internal diameter of the teeth 165. The user can then re-couple the handle 105 to the wrench head 110 by lifting up on the handle and coupling the first ball detent 140 with the teeth 165.

The spline 120 can be any shape with teeth 165 that engage with a ball detent. As shown, the spline 120 can be configured in eight double square or twelve triple square, hexagonal or double-hexagonal teeth, but any other structure that receives a ball detent can be implemented without departing from the spirit and scope of the present invention.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool comprising:

a handle having opposing first and second handle ends, the handle includes a spline at the first handle end;

a pin having first and second ball detents and first and second portions, wherein the first ball detent is adapted to releasably couple with the handle, and wherein the first portion includes a substantially circular cross-section and the second portion includes a substantially square cross-section.

2. The tool of claim 1, wherein the spline includes teeth, and wherein the first ball detent engages the teeth.

3. The tool of claim 1, wherein the handle includes a grip located at the second handle end.

4. The tool of claim 1, wherein the first ball detent extends across the first and second portions.

5. The tool of claim 1, wherein the spline includes teeth, and wherein the outer diameter of the first portion is smaller than the internal diameter of the teeth.

6. The tool of claim 1, wherein the drive portion includes an opening having a shape corresponding to a shape of the second portion.

7. The tool of claim 1, wherein the pin includes a head extending from the round portion.

8. The tool of claim 1, further comprising a wrench head releasably coupled to the handle via the pin and having opposing first and second wrench head ends, the wrench head includes a working portion at the first wrench head end and a drive portion at the second wrench head end.

9. The tool of claim 8, wherein the wrench head includes an indent in the drive portion, and wherein the second ball detent couples with the indent to couple the wrench head and pin together.

10. The tool of claim 8, wherein the spline includes teeth adapted to engage with the first ball detent, and wherein the wrench head includes an indent in the drive portion adapted to engage the second ball detent couples with the indent.

11. A tool comprising:

a handle;

a pin coupled to the handle, wherein the pin includes:

first and second ball detents, the first ball detent releasably coupling with the handle;

a round portion and a square portion extending from the round portion, the first ball detent extending at least partially within the round portion and the second ball detent extending within the square portion.

12. The tool of claim 11, wherein the first ball detent extends across the round portion and the square portion.

13. The tool of claim 11, wherein the handle includes a spline at a first handle end and a grip at a second handle end opposite the first handle end, wherein the spline includes teeth, and wherein the outer diameter of the round portion is smaller than the internal diameter of the teeth.

14. The tool of claim 11, wherein the pin includes a head extending from the round portion.

15. The tool of claim 11, further comprising a wrench head coupled to the pin, wherein the second ball detent is adapted to couple with the wrench head.

16. The tool of claim 15, wherein the wrench head has opposing first and second wrench head ends, the wrench head including a working portion at the first wrench head end and a drive portion at the second wrench head end.

17. The tool of claim 16, wherein the wrench head includes an indent in the drive portion, and wherein the second ball detent releasably couples with the indent to couple the wrench head and pin together.

18. The tool of claim 16, wherein the drive portion includes a square shape corresponding to a shape of the square portion.

19. A tool comprising:

a pin having first and second ball detents and first and second portions, the first ball detent is disposed at least partially in the first portion and the second ball detent is disposed in the second portion;

a handle having opposing first and second handle ends, the handle includes a spline at the first handle end, wherein the handle is selectively and releasably coupled to the pin at either one of the first and second portions, wherein when the handle is releasably coupled to the pin at the first portion, the handle is adapted to be rotated relative to the pin, and wherein when the handle is releasably coupled to the pin at the second portion, rotation of the handle relative to the pin is restricted.

* * * * *